United States Patent [19]

Campo

[11] Patent Number: 4,561,802

[45] Date of Patent: Dec. 31, 1985

[54] ASSEMBLY OF CONDUCTOR GUIDES FOR OFFSHORE DRILLING PLATFORM

[75] Inventor: Juan J. Campo, Metairie, La.

[73] Assignee: The Babcock & Wilcox Company, New Orleans, La.

[21] Appl. No.: 562,546

[22] Filed: Dec. 19, 1983

[51] Int. Cl.[4] ..... E02B 17/00

[52] U.S. Cl. ..... 405/195; 175/9; 405/227

[58] Field of Search ..... 405/195, 224, 227, 228; 175/9

[56] References Cited

U.S. PATENT DOCUMENTS

| | | | |
|---|---|---|---|
| 2,475,888 | 7/1949 | Hackett | 175/9 X |
| 3,991,581 | 11/1976 | Kolb | 405/227 |
| 4,027,734 | 6/1977 | Horvath | 175/9 |
| 4,050,731 | 9/1977 | Coone et al. | 405/195 X |

*Primary Examiner*—David H. Corbin

*Attorney, Agent, or Firm*—Robert J. Edwards; James C. Simmons

[57] ABSTRACT

A conductor guide assembly for conductors of an offshore well platform having a jacket with an interior pile for extending from a sea bed to above a water level which is over the sea bed. In accordance with one inventive feature, a first guide mechanism comprising a plurality of vertically spaced supports which hold the tubular conduits within the interior pile is assembled in a plurality of sections wherein the upper support of each section is provided with removable bolt-on units for supporting the first guide mechanism as successive sections are jointed thereto. In accordance with another inventive feature, a second guide mechanism comprises a pair of circular plates positioned to rotate within a lower deck opening and which are connected together and define a plurality of passages for receiving the plurality of conductors that extend in the interior pile. The connected plates are temporarily attached to the lower deck for transport so that the second guide mechanism can be detached and rotated to align the passages with the intended positions for the conductors whereafter the second guide mechanism is permanently attached to the lower deck. In accordance with another inventive feature, a third guide mechanism comprising a plurality of radially extending beams is supported on an upper deck. The second guide mechanism also has passages for access to the conductors and it too can be rotated into a position of alignment with the conductors and thereafter permanently fixed to the upper deck.

10 Claims, 13 Drawing Figures

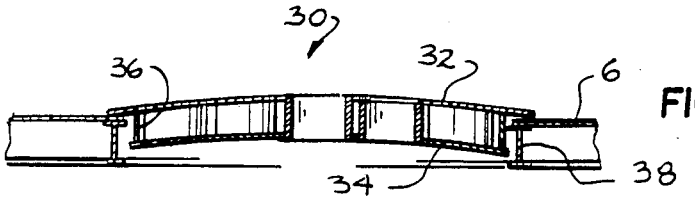
FIG. 8
FIG. 7
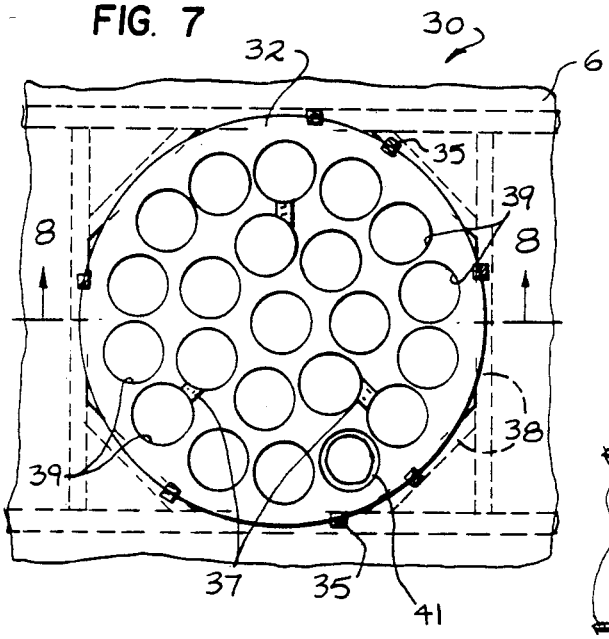
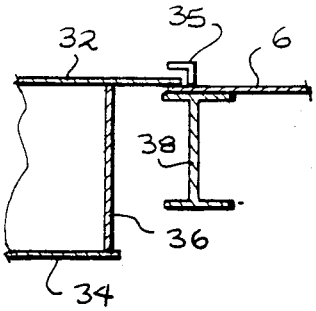
FIG. 9

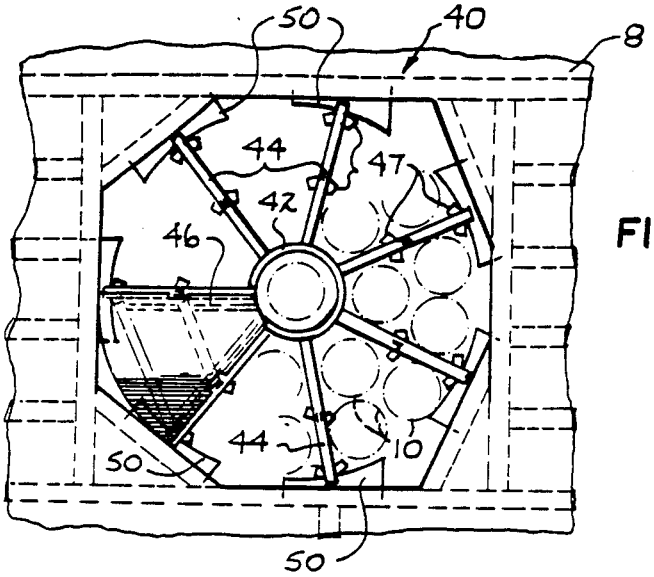
FIG. 10
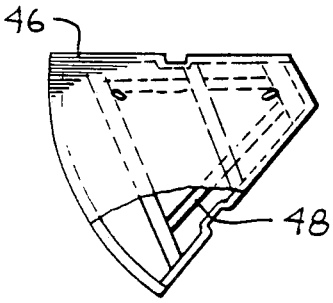
FIG. 11
FIG. 12
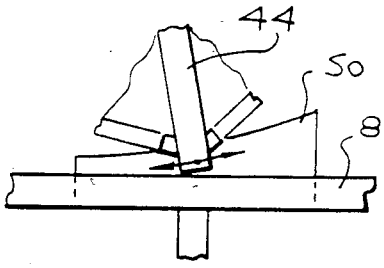
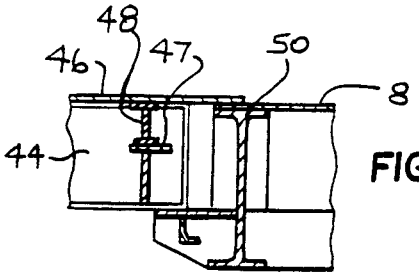
FIG. 13

ASSEMBLY OF CONDUCTOR GUIDES FOR OFFSHORE DRILLING PLATFORM

FIELD AND BACKGROUND OF THE INVENTION

The invention relates in general to offshore drilling platforms. More particularly, it relates to a new and useful conductor guide arrangement for positioning a plurality of tubular conductors used in an offshore drilling platform which conductors extend upwardly through a pile of the platform jacket.

The drilling of wells at offshore locations using offshore platforms is accomplished through large diameter steel pipes, called conductors, which are driven into the soil at the sea bed through guides connected to a jacket and deck structure of the offshore platform. The jacket is a tubular steel framework that serves as a pile template and extends from the sea bed to a few feet above the wate level. Steel superstructure of the platform including decks are connected to the piling or the jacket to support the drilling and production facilities.

The piling consists of steel tubes which secure the platform to the sea bed and penetrates the soil up to 300 to 600 feet. The platform components such as the jacket, one or more decks, and piling, are built on land at fabrication yards as completely as possible in order to minimize the far more expensive offshore construction at the offshore site.

Conductor guides for positioning and guiding the conductors are framed at various elevations within the jacket and decks to provide support for the conductors such that the usual effects of environment such as waves, winds, current and the like can be safely withstood by the conductors and to maintain conductor alignment.

There are two kinds of conductor guide systems which have been utilized in the offshore industry. The first system, which is more common and older, consists of guides which are rigidly connected to the jacket and deck framework. The conductors are placed through these guides. The conductor guides and structural framework provide support for the conductors at various levels throughout the jacket and deck or decks. This type of system generally includes three kinds of conductor guide assemblies. The first kind are those within the horizontal frawework levels of the jacket and typically consist of vertical guides made out of steel tubes welded to the horizontal jacket tubular members. The other types are located in the upper and lower deck levels. The lower deck level guides are similar to those of the jacket except that they are rigidly connected to the deck floor beams. These guides are located in line with the jacket guides. The upper deck level assembly consists of a grid of beams bolted to the permanent upper deck beams supporting removable hatches which line up with the conductor guides in the lower deck. Access is provided to the lower deck level, which is typically the conductor termination level, by removing the hatches. While advantages of this type of system include the fact that conductor guides and framing are normally built within the jacket and deck during land fabrication, when jackets are set over existing wells, offshore construction thereof is required. Another problem is that this type of arrangement may not sufficiently withstand extreme environmental effects such as mud slides or ice movement.

The second type of arrangement, which has recently been utilized in areas of extreme environmental loading such as mud slide zones, consists of jacket conductor guides positioned inside a large diameter pile which has previously been driven through a jacket sleeve. The pile protects the conductors from environmental loading. The typical jacket conductor assembly consists of a series of horizontal guide frames connected to a central post and supported by the pile at its top. Additional guide assemblies similar to those described with respect to the first type of arrangement are provided in the decks of the platform. Because the jacket conductor guide assembly must be erected offshore after the jacket and piling are installed, it is required that the conductor guides for the deck sections be built offshore to conform to the orientation of the conductor guides in the pile.

Due to its length, the jacket assembly is built on land in several sections which are subsequently installed and welded together offshore. However, temporary beams are required for supporting the structure as it is assembled and installed at the offshore site. The handling of such beam supports on the top of the pile for large guides is time consuming and sometimes requires the use of cranes or similar equipment. As the jacket structures have become larger and larger, such beam supports have become more and more difficult to handle.

The present invention is drawn to a conductor guide assembly and method of assembling the same for a plurality of conductors for an offshore drilling or well platform. A first conductor guide means is disposed in and supported by and on the interior pile which extends through the jacket from below and sea bed to above the water level over the sea bed.

In accordance with one inventive feature, a second guide means is associated with at least one lower deck of the platform that is connected to the jacket. A plurality of passages are defined in the second guide means through which the conductors extend and are positioned with respect to the lower deck. The second guide means is temporarily connected such as by spot welding to the lower deck at the land based fabrication facility. It can thus be detached temporarily so that it can be rotated to align the passages with the plurality of conductors or at least the positions for the conductors in the interior pile. Thereafter, the second guide means is permanently connected, usually by welding, to the lower deck.

In accordance with another inventive feature, a third guide means is provided on the upper deck which also has a plurality of passages for permitting access to the plurality of conductors. The third guide means is supported by beams in the upper deck which permit limited rotation of the third guide means to align passages thereof with the passages of the second guide means.

In accordance with another inventive feature, the first guide means comprises a plurality of frame arrangements which are each equipped with removable bolt-on units that can be used to support the unfinished first guide means as sections thereof are assembled above the interior pile. The bolt-on units can then be removed to drop the first guide means, section by section, into the interior pile as additional sections are added.

Accordingly, an object of the invention is to provide a conductor guide arrangement which facilitates the positioning and guiding of conductors in an offshore platform so that the amount of construction work required at the offshore site is minimized.

A further object of the invention is to provide a method for assembling such a conductor guide arrangement.

Yet another object of the invention is to provide a method for assembling a conductor guide arrangement wherein the burdensome requirement of using temporary beams to support the structure is eliminated.

A still further object of the invention is to provide a conductor guide arrangement for offshore platforms which is simple in design, rugged in construction, and economical to manufacture.

The various features of novelty which characterize the invention are pointed out with particularity in the claims annexed to and forming a part of this disclosure. For a better understanding of the invention, its operating advantages, and specific objects attained by its uses, reference is made to the accompanying drawings and descriptive matter in which preferred embodiments of the invention are illustrated.

IN THE DRAWINGS

FIG. 7 is a top plan view of second guide means for positioning and guiding the conductors in a lower deck of the platform;

FIG. 8 is a view taken along lines 8—8 of FIG. 7;

FIG. 9 is an enlarged detailed view of the relationship between the second guide means and the lower deck;

FIG. 10 is a top plan view of third guide means connected to an upper deck of the platform for providing access to the conductors;

FIG. 11 is a top plan view of a hatch used in the structure of FIG. 10;

FIG. 12 is a detailed top plan view of the association between the third guide means and the upper deck; and FIG. 13 is a sectional detail view showing the support of the third guide means on the upper deck.

Figure 1:
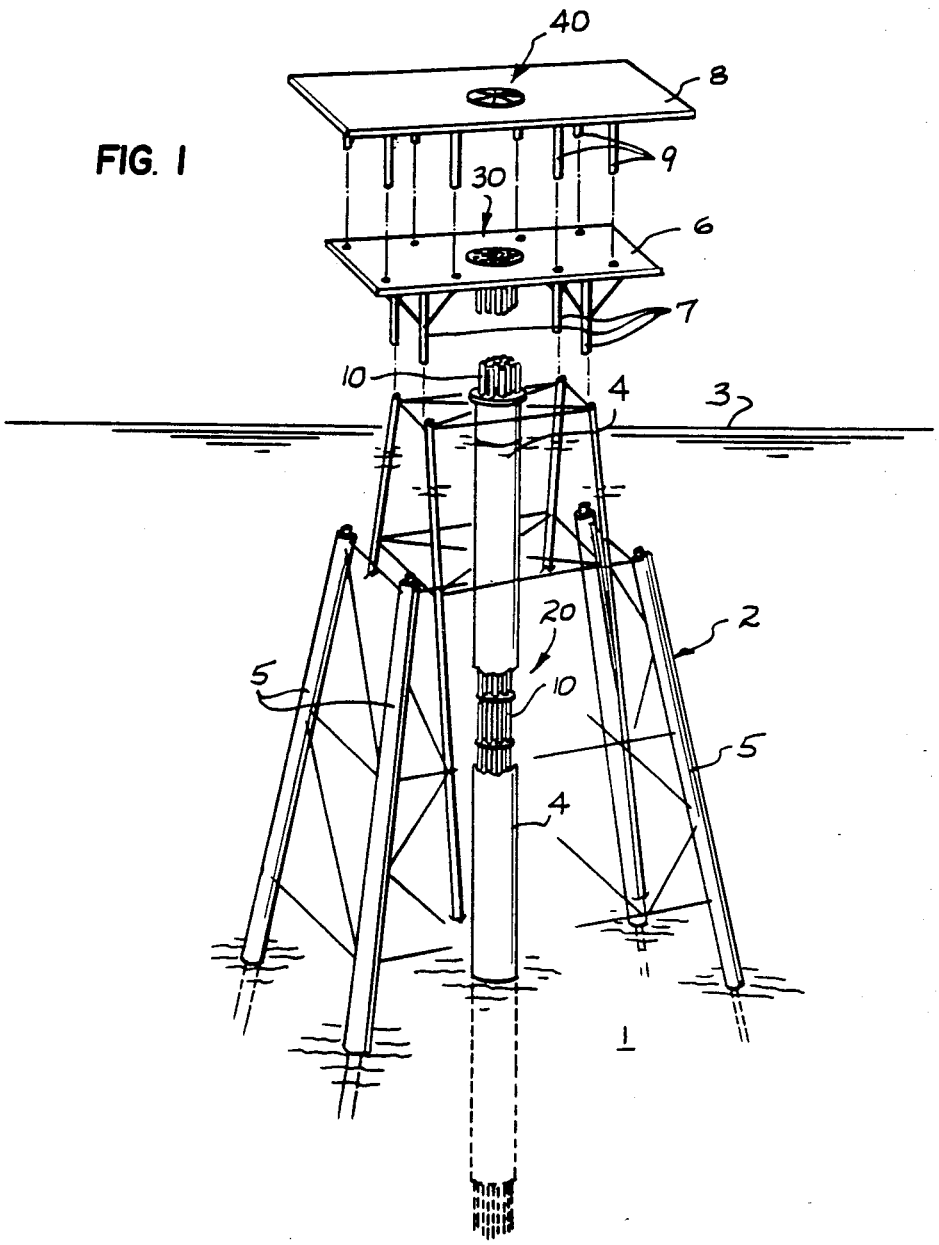
FIG. 1 is an exploded perspective view of an offshore platform with conductors and a conductor guide assembly according to the invention.
Figure 2:
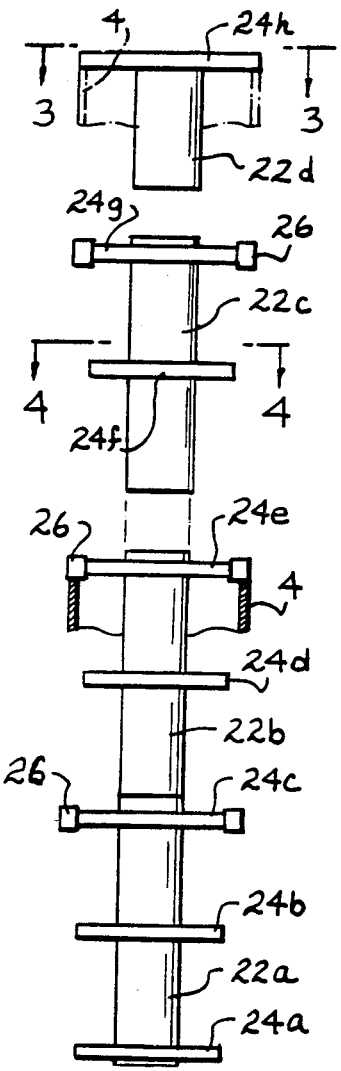
FIG. 2 is a side elevational and exploded view of first guide means for positioning conductors in an interior pile of the offshore platform.

Referring to the drawings in particular, an offshore drilling platform is shown in FIG. 1 which is connected to a sea bed 1 and extends up to and above a water level 3 above the sea bed. The platform includes a jacket generally designated 2 which is a framework made of steel tubing and generally includes four corner piles 5 which are sunk into the soil of the sea bed or otherwise anchored to the sea bed.

A pile 4 extends through the interior of the jacket 2. This is a tubular structure that is typically between about 8 and 15 feet in diameter and may be inserted in sleeve which has been fabricated and installed in the jacket ashore. The pile 4 may be driven into the sea bed for up to 300 to 600 feet.

Interior pile 4 extends to a few feet above the water lever 3 and contains a plurality of conductors 10 through which access can be had to the sea bed and below. The conductors each have a diameter of typically between about 20 and 30 inches and are positioned and guided in the interior pile 4 by first guide means generally designated 20 to be described in detail hereinunder.

The platform is provided with one or more lower decks 6 and at least one upper deck 8. Decks 6 and 8 are connected to the jacket through supports 7 and 9 respectively.

Second guide means generally designated 30 are connected to the lower deck 6 and define passages for the conductors 10. Third guide means generally designated 40 are connected to the upper deck 8 and also define passages which are aligned with the passages of the second guide means 30 and provide access to the tops of the conductors.

As shown in FIGS. 2 through 6, the first guide means 20 is made up of a plurality of sub-assemblies which each include a vertical center post **22*a* through 22*d*. Sections 22*a*, 22*b*, and 22*c*, which are adapted to be received entirely within the interior pile 4, each include one or more but preferably at least two steel frame structures 24*a* through 24*c* for section 22*a*, 24*d* and 24*e* for section 22*b*, and 24*f* and 24*g* for section 22*c*. The upper structure 24*c*, 24*e*, and 24*g* of each section 22*a*, 22*b*, and 22*c* respectively is provided with a plurality of removable support brackets 26 which establish an effective outer diameter for the structures which is greater than the diameter of the interior pile 4**.

The steel frame structure **24*h* at the top of the top section 22*d* has an outer diameter (without any support bracket) which is greater than the diameter of the interior pile 4 so that it can be permanently supported on top of the interior pile 4** to support and suspend the remainder of the second guide means thereunder.

Figure 3:
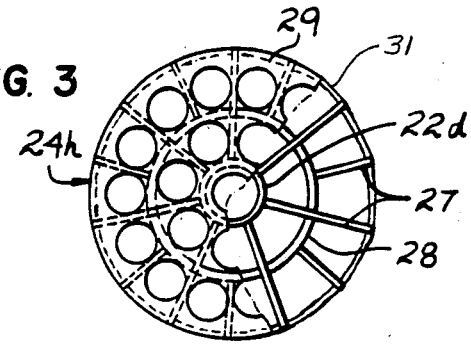
FIG. 3 is a view taken along lines 3—3 of FIG. 2.

As shown in FIG. 3, the uppermost steel frame **24*h* includes a plurality of steel plate spokes 27 extending radially outwardly of the center post 22*d*, an intermediate ring 28 and outer ring 31 which are also made of steel plate, and an upper plate 29 having apertures therein for receiving a plurality of conductors 10**.

Figure 4:
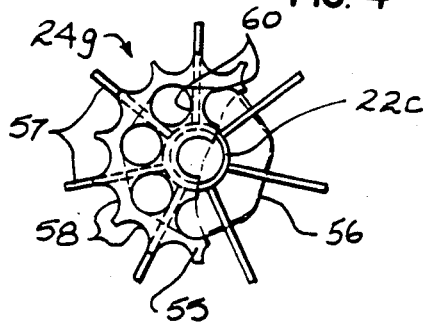
FIG. 4 is a view taken along lines 4—4 of FIG. 2.

As shown in FIG. 4, a steel frame structure **24*f*, which is typical of all the frame structures except for the top frame structure 24*h*, comprises a plurality of steel plate spokes 57 extending radially outwardly of the center post 22*c*, a conductor engaging band 56, and a cover plate 55. As shown in FIG. 4, cover plate 55 includes semicircular recess 58 as well as openings 60 aligned with similar recesses 58 and openings 60 in other cover plates for positioning a plurality of the conductors 10 at selected locations. In a similar way, plate 28 of frame structure 24*h* provides aligned apertures for positioning of the conductors in the same pattern. The center posts 22*a* to 22*d* may also serve as conductors. Although sufficient alignment may be provided by positioning conductors between semicircular recesses 58 and the piling wall, the plurality of spokes 57** are preferably provided to extend outwardly to the piling wall for maintaining concentricity.

Figure 5:
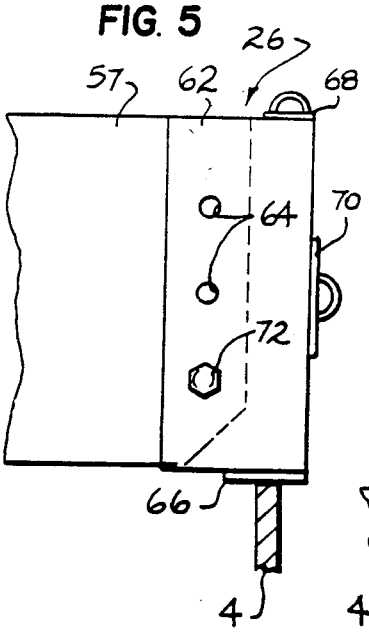
FIG. 5 is a detailed view of a removable support bracket for the structure of FIG. 2.
Figure 6:
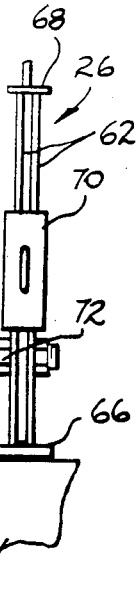
FIG. 6 is a side elevational view of the support bracket shown in FIG. 5.

In assembling the first guide means 20, a plurality of support brackets 26 are bolted to outer ends of some of the spokes 57. At least two but preferably three or four equally spaced support brackets can be utilized. As shown in FIG. 5, each support bracket includes a pair of vertical plates 62 spaced apart to minimize the bracket weight while providing adequate support. Plates 62 have aligned apertures 64 therethrough and are connected together by a bottom plate 66, the upper plate 68 of a lifting eye, which lifting eye hook point is aligned with the center of gravity of the bracket for stability during lifting thereof, and a side plate 70 of another lifting eye. Apertures 64 are aligned with apertures through the end of spokes 57 to receive bolts, one of which is shown at 72. As shown in FIG. 5, the support bracket 26 increases the effective outer diameter of the respective frame structure 24*c*, 24*e* and 24*g* so that bottom plate 66 rests on the top of interior pile 4.

In assembly, the first or lowest section with vertical center post 22*a* is lowered into the open top end of pile 4 until the bolted on supported brackets 26 rest on the top edge of the pile as shown in FIG. 5. The next section with vertical center post 22*b* is then lowered and stabbed to the lower section. After this section is rotated to a preferably keyed position to align its conductor openings 58 and 60 with those of other sections, the two center posts 22*a* and 22*b* are then welded together.

The two sections which are now assembled are then lifted slightly to permit removal of support brackets 26 from structure 24*c* and then lowered into the interior pile 4 until brackets 26 which have previously been connected to frame structure 24*e* rest on the open top of the pile. Thereafter the next higher section having center post 22*c* is lowered, stabbed, and welded to the section having center post 22*b*, and the support brackets are thereafter removed from structure 24*e*. This process continues until the top section carrying center post 22*d* is lowered. Since it carries the upper structure 24*h*, it automatically rests on the top edge of pile 4 and permanently supports the remaining sections.

It is customary to provide steel frame structures for positioning the conductors 10 at 40 to 60 foot intervals in the interior pile 4.

Referring now to FIGS. 7 and 9, the second guide means 30 includes a cover plate 32 which is cambered as shown in FIG. 8 and includes a plurality of aligned openings 39 which define passages for receiving and positioning the conductors 10. Plate 32 is of such a diameter that the outer periphery of plate 32 can overlie an opening in the upper deck and rest on the upper deck portions which lie adjacent to and define such opening. It is preferred that plate 32 rest on a plurality of upper desk beams 38 to assure adequate support. Referring to FIG. 7, it should be noted that the conductor passages are not symmetrically positioned. Thus, if the second guide means 30 is to be constructed at an onshore site for installation at the platform, the conductor openings may be provided therein at the onshore site but the conductor openings must align with the conductor openings of the first guide means 20 when the second guide means 30 is installed. In order to achieve such alignment in accordance with the present invention, the plate 32 is provided to be circular to rotate about its center over beams 38, and small lengths of angle iron 35, which are welded to beams 38, extend along and are spaced about the cover plate circumference and extend over the periphery of plate 32 to maintain its center position. Three lifting eyes 37 are welded to cover plate 32 for lifting the plate.

It was discovered that such a single plate 32, which may typically have a diameter of 17 feet, will tend to deflect under its weight, resulting in its conductor passages not remaining aligned with the first guide means conductor passages. In order to reduce such deflection so that the alignment is maintained in accordance with a preferred embodiment of the present invention, the second guide means 30 is also provided with a circular and similarly cambered and apertured lower plate 34 which has a diameter which is less than the cover plate diameter to fit within the space of the lower deck opening and between the beams 38, as shown in FIG. 8. Opening 39 may be outfitted with suitable sleeves as illustrated at 41 in FIG. 7 for receiving the conductors. The cover and lower plates 32 and 34 respectively are spaced apart and connected together by a circular ring 36 welded to the plates 32 and 34 and sleeves 41 to further increase the rigidity and resistance to deflection thereof.

In manufacturing the platform at the land based facility, plate 32 is spot welded into place at short weld locations. At the offshore site, these weld locations are torch cut so that plate 32 with its connected ring 36 and lower plate 34, can be rotated to align the passages defined by openings 39 with the passages already defined in the first guide means of the interior pile 4. Conductors 10 can thus be slipped through openings 39 and into their positioning passages in the first guide means.

While only a single second guide means is shown, a plurality of lower decks may be provided. Each of these additional lower decks, or only some of them, may be outfitted with a second guide means 30 as illustrated in FIGS. 7 through 9.

Referring now to FIGS. 10 through 13, the upper deck is equipped with third guide means 40 having a center hub 42 with radially extending steel beams 44 configured as the spokes of a wheel and overlying an opening in the upper deck. As shown in FIG. 10, beams 44 define sector shaped generally triangular areas which may each provide access to the tops of a plurality of conductors 10 which are actually below the upper deck as viewed from FIG. 10. Each of these areas may be covered by a hatch 46, shown in FIG. 11, having its own frame structure 48. Seat plates 47 are bolted or welded to beams 44 for supporting the hatches 46 which can be bolted to these seat plates for easy removal and access to the tops of the conductors 10.

The upper deck is provided with deck beams 50 forming seats on which outer edges of beams 44 can rest and permitting rotation of the circular second guide means 40 about the hub 42 to align the passages with the configuration of conductors. After alignment, the outer edges of beams 44 can be bolted or welded to beams 50.

Since rotation of the third guide means 40 through a small angle covering the diameter of a conductor passage 39 is considered sufficient to align the third guide means pre-shaped openings with the second guide means passages. Thus, it is considered sufficient if the deck beams 50 extend over a distance circumferentially of the third guide means equal to half of the conductor passage diameter one each side of a radius from the hub which lies in a plane which passes between a pair of adjacent inner row conductor passages 39 of the second guide means 30.

Although the beams 44 may be either welded or bolted to the hub 42 and beams 50, it is preferred that some beams 44 be bolted to allow their removal so that openings may be provided which are large enough to pass large apparatus such as blowout preventers therethrough, and that others of the beams 44 be welded to provided support without the danger of the third guide means falling to a lower deck if all of the beams were unbolted. For example, alternate beams may be welded, and alternate beams may be bolted.

Some features of the present invention can be used to advantage without use of other features of the invention. While a specific embodiment of the invention has been shown and described in detail to illustrate the application of the principles of the invention, it will be understood that the invention may be embodied otherwise without departing from such principles.

What is claimed is:

1. A conductor guide arrangement for conductors of an offshore well platform having a jacket comprising:

a pile extending from a sea bed to above a water level over the sea bed;

a plurality of center posts connectable end to end of disposition in the pile for positioning a plurality of conductors in the pile, at least one frame structure connected at an end portion of each of said center posts defining a plurality of alignable passages for the plurality of conductors, at least one of said frame structures having a plurality of plate spokes extending radially outwardly of said respective center post a distance in a plurality of radial directions respectively which is less than a radius of the pile so that said frame structure can fit inside the pile, and a plurality of support brackets removably connectable to at least some of said plate spokes to increase the radius of each spoke to which a support bracket is connected so that it is greater than the radius of the pile to rest on a top edge of the pile and thereby support portions of said guide means for assembly thereof.

2. A conductor guide arrangement according to claim 1 wherein each of said support brackets is bolted to a spoke.

3. A conductor guide arrangement according to claim 1 wherein at least two frame structures are connected to each said center post and spaced apart axially thereof, and said support brackets are connected to the uppermost frame structure of the respective center post.

4. A conductor guide arrangement according to claim 1 wherein the conductor passages are alignable by aligning an upper and a lower center post in end to end relation, rotating the upper center post to align the passages, and welding the upper to the lower center post.

5. A conductor guide arrangement according to claim 4 including an uppermost frame structure connected to an uppermost one of said center posts and having a diameter greater than the diameter of the pile for supporting said assembled center posts on a top edge of the pile with said assembled center posts extending into the interior pile.

6. A method of assembling a conductor guide arrangement for a plurality of conductors of an offshore well platform including a jacket comprising:

positioning a pile to extend from a sea bed to above a water level over the sea bed;

preparing a first center post with at least one frame structure having passages for guiding conductors in the pile and connected to the first center post at the upper end portion thereof and extending radially outwardly from the first center post to a diameter less than an inner diameter of the pile;

removably attaching a plurality of support brackets to said at least one frame structure on the first center post to increase the diameter of such frame structure to be greater than that of the pile;

positioning the first center post in the pile with the removable support brackets supported on an upper edge of the pile;

preparing a second center post with at least one frame structure similar to said first frame structure;

fixedly attaching a lower end of the second center post to an upper end of the first center post;

supporting the connected first and second center posts by means independent of the support from the support brackets; and removing the support brackets from said at least one frame structure of the first center post.

7. A method according to claim 6 further comprising:

connecting a plurality of support brackets to the at least one frame structure of the second center post;

lowering the connected first and second center posts into the pile until the support brackets on the at least one frame structure of the second center post rests on the upper edge of the pile;

preparing at least one additional center post having at least one frame structure similar to said first and second center post each for connection to the next lower center post;

preparing an uppermost center post which has a frame structure on the upper end portion of the uppermost center post and which has diameter greater than the inner diameter of the pile;

connecting the uppermost center post to the at least one additional center post; and lowering the connected center posts with frame structures further into the pile until the frame structure of the uppermost center post rests on the upper edge of the pile of supporting the assembled conductor guide arrangement.

8. A method according to claim 6 wherein the support brackets are bolted to plate spokes extending radially outwardly from each said frame structure.

9. A method according to claim 6 further comprising rotating the second center post relative to the first center post to align the conductor passages in the frame structures of the first and second center posts prior to fixedly attaching the first and second center posts.

10. A method according to claim 6 wherein at least two frame structures are connected to each said center post and spaced apart axially thereof, and said support brackets are connected to the uppermost frame structure of the respective center post.

* * * * *